US005156221A

United States Patent [19]

Breitenmoser

[11] Patent Number: 5,156,221

[45] Date of Patent: Oct. 20, 1992

[54] METHOD OF AND ARRANGEMENT FOR CONTROLLING THE OPERATION OF A HAND-HELD ELECTRICAL DEVICE

[75] Inventor: Armin Breitenmoser, Ulisbach, Switzerland

[73] Assignee: CEKA Elektrowerkzeuge AG & Co. KG, Wattwil, Switzerland

[21] Appl. No.: 718,538

[22] Filed: Jun. 21, 1991

[30] Foreign Application Priority Data

Jun. 22, 1990 [DE] Fed. Rep. of Germany ..... 4019895

[51] Int. Cl.[5] ..... B25B 23/157

[52] U.S. Cl. ..... 173/1; 173/179; 81/473; 192/0.02 R; 192/0.084

[58] Field of Search ..... 173/1, 7, 11, 12, 13, 173/18, 93, 104, 105; 192/0.02 R, 0.84, 30 W, 34; 81/469, 470, 473, 475, 476

[56] References Cited

U.S. PATENT DOCUMENTS 3,896,914 7/1975 Konsbruck et al. ..... 192/0.084
3,906,819 9/1975 Curtis ..... 173/12
4,194,608 3/1980 Usui et al. ..... 192/0.084
4,838,364 6/1989 Hansson ..... 173/12
4,986,369 1/1991 Fushiya et al. ..... 173/12
5,025,903 6/1991 Elligson ..... 173/13
5,044,234 9/1991 Cheng ..... 81/473
5,060,733 10/1991 Kress ..... 81/473

*Primary Examiner*—Frank T. Yost
*Assistant Examiner*—Scott A. Smith
*Attorney, Agent, or Firm*—Darby & Darby

[57] ABSTRACT

An electrical hand-held device, such as a screwdriver or the like, includes an output shaft, a drive motor for driving the same, an actuating coupling for connecting the output shaft with the drive motor, a distance sensor for sensing a coupling position, and a speed controller which, in response to a signal generated by the distance sensor, controls operation of the drive motor. The controller causes the drive motor to accelerate to a high speed and maintain this speed during the screwing process when a rearward pressure is applied to the output shaft and the coupling is in its clutching position.

7 Claims, 2 Drawing Sheets

METHOD OF AND ARRANGEMENT FOR CONTROLLING THE OPERATION OF A HAND-HELD ELECTRICAL DEVICE

BACKGROUND OF THE INVENTION

The invention relates to a method of and an arrangement for controlling the operation of a hand-held electrical device comprising an axially displaceable output shaft driven by an electric motor via a coupling.

The invention in particular relates to electrical hand-held devices such as screwdrivers and will be explained in detail on a basis of a screwdriver, though it should be understood that the basic principles of the invention are applicable not only to the screwdrivers but may be applied with accompanying advantages to any other hand-held electrical devices, especially such as drills, drill hammers, etc.

In screwdrivers, usually a form-locking coupling, i.e., a claw coupling, is used for transmitting a torque from the electric drive motor. This coupling breaks the form-locking connection between the motor drive and the working spindle when the working spindle, which gradually slides forward during the screwing operation and cooperates with a depth stop, reaches a predetermined thread depth. The claws then disengage from each other, so that the screwing operation ends.

Often such claw coupling is used with an additional device, i.e., such as a slip coupling (disclosed in German patent 3,637,852). This coupling is set to operate in such a manner that it provides for complete separation of the claw coupling elements by increasing the distance between the claw coupling elements immediately at the first slipping of the claw coupling to prevent further mutual slipping of the separate claws, especially in the moment of beginning of declutching, to thereby prevent noise accompanying slippage as well as wear.

This type of control of torque transfer is also used in a power screwdriver according to European patent application No. 90102260.8. In the European application, the torque-limiting slip coupling, which is associated with the coupling elements of the claw coupling located on the side of the driving shaft, includes at least one axial opening in a form of a guide pocket that opens toward the screwdriver tool and has a bottom inclined relative to the longitudinal axis of the driving shaft, and a transverse pin supported on the driving shaft for joint rotation therewith and for engaging the guide pocket.

Another power cut-off screwdriver is disclosed in German Offenlegungsschrift 30 15 423. In this screwdriver, the working spindle stops, when a predetermined limiting torque is exceeded, not as a result of turning-off of the electric motor but due to the coupling declutching whereby further movement of the working spindle beyond a marked position, defined by a pressure point, outward of the guide element can be effected anew. However, a position is then arrived at in which this automatic uncoupling is not possible.

There exists another problem with these screwdrivers when screw elements are fitted in a rapid succession on a holder of a working spindle or output shaft of a screwdriver, and the working spindle, with a strong thrust to insure screwing, is pressed backward to move the claw coupling into the coupling position. Such a method, which is by itself questionable, poses an additional problem for an operator accustomed to working with such screwdrivers when he has to work with a pressure-starting push-in or tachymetric switch, and the drive motor, on fitting a new screw element, is not turned off and the idle speed is not reduced. In this case, the stationary condition of the shaft, necessary for fitting of a screw element, is provided by declutching of the claw coupling. After the screw element is fitted on, the spindle is simply pressed again with the drive motor rotating at high speed (i.e., 3,000–5,000 revolution per min.). Here, the coupling process takes place when the operator presses rather strongly to bring the two claw coupling parts in engagement with each other. Nevertheless, such process cannot prevent poor engagement of the claws because the claws of one coupling part have a zero speed whereas the other coupling part, in this screwdriver, has a high speed. It is difficult to achieve a maximum output with such a screwdriver and one has to put up with considerable noise as the device operates with the maximum working speed or a speed close to the maximum speed though, even with rapid fitting of the screw elements, only 10% of the working time is spent on screwing while the other 90% is spent setting the device and fitting the new screw elements.

A further disadvantage of the prior art screwdrivers lies not only in that, with the maintaining of a high idle speed, a high coupling wear takes place during engagement of the coupling, but also in that the service lives of other elements of the device such as bearings, switches, etc., are also reduced when the device is operated, under normal conditions, with high speed. Such an operation is also accompanied by a disturbing and unacceptable noise.

SUMMARY OF THE INVENTION

The object of the invention is to avoid the above-mentioned disadvantages of the electrical hand-held device, in particular such as screwdrivers, drills, hammer drills, etc., and to provide a device which, on one hand, will ensure a maximum output and, on the other hand, will avoid any problems in the form-locking-type couplings (claw couplings) resulting from an extremely high difference between the speeds of the coupling parts.

The object of invention is achieved by providing a distance sensor that senses a position of the output shaft or the coupling and generates a control signal in response to which a speed controller changes the motor speed from a high working speed to a reduced idle speed or vice versa, depending on the coupling condition. The invention provides that in the moment of engagement of the coupling parts, the speed difference therebetween is reduced while the device remains in a switch-on condition to ensure a rapid resumption of the operation of the hand-held device. It is important that the device does not work against the operator and that the maximum output can be consciously reduced by him. The invention provides for attaining optimal operational conditions, in the moment of coupling, for the device itself and the coupling parts. These conditions ensure, on one hand, avoidance of a tooth-against-tooth position that would hinder the coupling process and, on the other side, a smooth transition into a clutched state and immediate acceleration, upon attaining the form-locking position of the claws with a full force, to a desired working speed which may be the maximum speed of the device.

Another advantage of the invention consists in that, with a relatively small speed difference between the coupling parts and the resulting substantially improved coupling process, the wear of the coupling and the noise are both substantially reduced. This is achieved by maintaining, in accordance with a preferred embodiment of the invention, a reduced speed during intervals between screwing of separate screw elements.

It is especially advantageous that, at the reduced idle speed, which always occurs at declutching of the form-locking (claw) coupling, the service life of different elements such as bearings, switches, drive motors collectors, significantly increases, and no knocking or vibration occurs in the coupling area.

Further, the reduced speed during clutching ensures a significant reduction in noise because now there is no noisy rattling of coupling parts one against the one, and the coupling process runs uniformly and undisturbed. Thus, the invention succeeds in eliminating problems that plagued the prior art devices, especially so-called "Pro-devices".

BRIEF DESCRIPTION OF THE DRAWINGS

The embodiments of the invention are shown in the drawings and will be explained in the following detailed description of the invention. In the drawings.

DESCRIPTION OF PREFERRED EMBODIMENTS

The fundamental idea of the invention consists in registering the coupling position and, in the moment of attaining the form-locking connection of the coupling parts, instructing a circuit for controlling the speed of the electric drive motor to bring the speed, if desired, to a predetermined working speed or the maximum motor speed.

According to one embodiment of the invention, a relatively low idle speed is selected so that, first, it is ensured that at application of pressure to the working spindle, when also the screwing process begins, the coupling is completely set and, second, the operation begins not from a zero speed, but with acceleration from the already idle speed of the rotating rotor so that practically no delay occurs. Besides preventing the coupling wear and other advantages, the present invention also provides for self-optimization of the screwing operation because the reduced speed at the start of the operation is easily adapted to regulation, and the screw element can easily engage the preliminary made thread with subsequent screwing at high speed.

Figure 1:
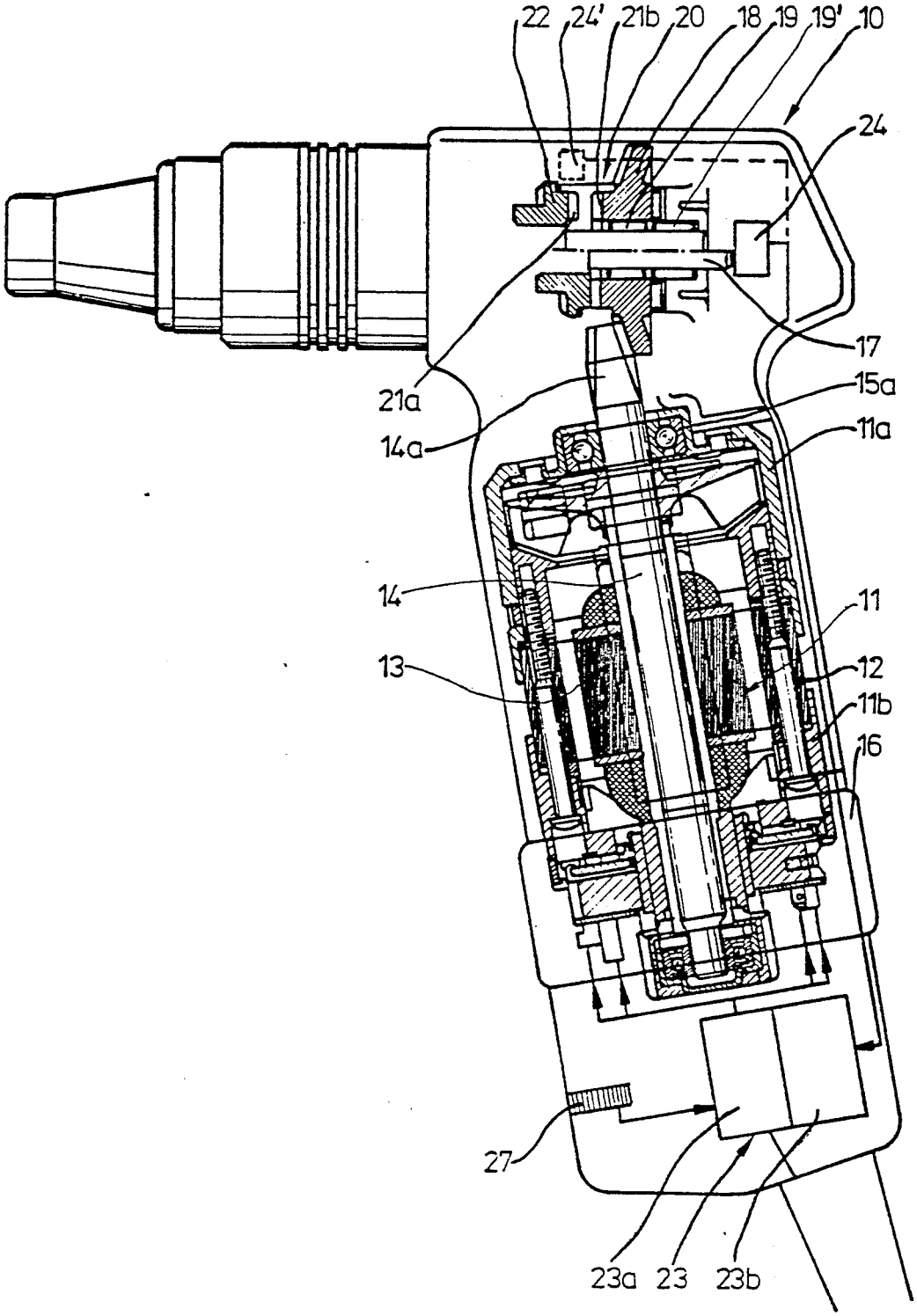
FIG. 1 is a schematic partially cross-sectional side view of one illustrative embodiment of a screwdriver.

FIG. 1 shows an embodiment of a screwdriver with a controlled coupling position according to the invention in which a drive motor 11 of the screwdriver 10 is located in the handle of the screwdriver, as is customary in hand gun screwdrivers.

The electric drive motor includes, in a conventional manner, A-end shield 11*a*, B-end shield 11*b*, stator 12 enclosed by the end shields, and a rotor 13 rotatable inside the stator by the stator magnetic field. The rotor 13 has a shaft 14 supported at opposite ends thereof in bearings 15*a* and 15*b* of the end shields 11*a* and 11*b*, respectively. The motor has a particular feature that consists in that the brush holder of the motor is formed as an inner rotatable jumper ring associated with a stamp plate and, via an opening in the housing, with an outside adjusting ring 16. By rotating the adjusting ring 16 mounted on the handle of the device 10, it is possible to select a desired direction of rotation of the screwdriver, whereby it is possible to turn off the device by moving the adjusting ring into an intermediate position. This permits considerable simplification of the screwdriver, as well as in its construction and the assembly. The rotor shaft 14 has an end portion 14*a* projecting out for the A-shield 15*a* and engaging, in the shown embodiment, a conical gear 18 mounted coaxially with the device spindle 17. It should be clear that between the conical gear 18 and the rotor shaft other drives or drive components may be connected, if desired. It should be further understood that the conical gear 18 need not necessarily be mounted on the output shaft of the device (device spindle 17) as shown in the described embodiment. The conical gear 18 is freely rotatable about a needle bearing 19 which is carried by the shaft 17 which in turn is supported in another needle bearing 19'.

In the embodiment shown in FIG. 1, the conical gear 18 simultaneously forms a coupling part of a form-locking coupling 20, which is formed, preferably, as a claw coupling and has six axially extending claws 21*b* cooperating with an opposite crown 21*a* of the other coupling part 22 fixedly connected with the output shaft 17 of the device.

The output shaft 17 is spring-biased or otherwise preloaded outward, to the left in the plane of the drawing, so that the claw elements 21*a* and 21*b* of the claw coupling 20 are held spaced from each other and so that the output shaft 17 may rotate when the motor driving the conical gear 1 is inoperative.

Figure 3:
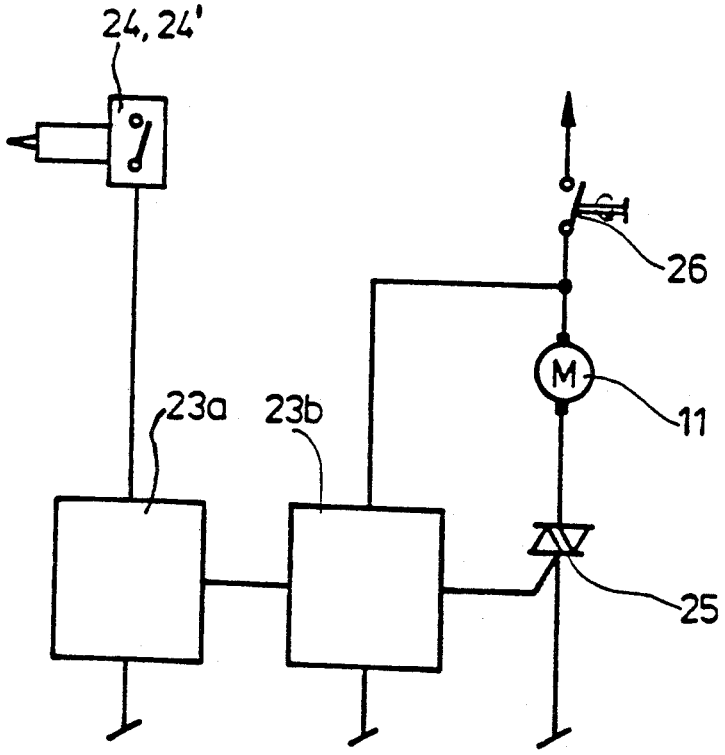
FIG. 3 is a substantially simplified block diagram schematic of a speed control arrangement for screwdrivers in accordance with this invention.

In this position, the operator is able to fit a new screw element onto the holder (not shown). Thereafter, the operator presses the screwdriver against a part in which the screw element is received to actuate the screwdriver, the output shaft 17 of the device moves backward so that the claw coupling elements 18 and 22 of the claw coupling 20 move toward each other. Of course, the form-locking coupling may be obtained in some other appropriate manner. According to the invention, there is provided a distance sensor 24 or 24' which, as discussed below, is in an appropriate location and is so formed that it determines at what moment and at what position the claw coupling 20 is clutched, that is when the driven conical gear 18, freely rotatable on the device output shaft 17 or another support and representing a first coupling part, form-lockingly engages the second coupling part 22. At this moment, the speed controller 23 generates an acceleration signal. The controller 23 as shown in FIG. 3, may comprise a control circuit 23*a* and a phase regulator 23*b* for controlling the motor drive.

It should be understood that the distance sensor may be formed in a number of ways; however, it should be so formed that it, upon clutching of the claw coupling, follows the rotation of output shaft 17 and generates a corresponding signal which is communicated as an acceleration signal to be processed and evaluated by the speed controller 23.

To this end, a simple mechanical switch can be used as a distance sensor, i.e., a microswitch actuatable by the output shaft when it moves backward. It is also possible to form the distance sensor as a contactless sensor, i.e., as an inductive or capacitance proximity switch, as a photo relay, as a Hall-sensor, or as a pneumatic switch whereby the location of the sensor can be conveniently selected. For example, referring to FIG. 1, the distance sensor 24 may be arranged on the end of the device output shaft 17, or, as shown by the dash lines, the sensor 24' may be arranged in the area of the coupling.

The control arrangement operates as follows: the control circuit 23*a* (FIG. 3) receives from the sensor 24 or 24' a "Yes/No" signal that is "clutch-declutch" signal. The control circuit 23*a* may be formed as a resistance circuit or from such elements that are able to evaluate the corresponding signal from the distance sensor 24 or 24' and then actuate the phase regulator 23*b*. The phase regulator 23*b*, in turn, starts the motor 11, preferably via a triac 25 switchable in both half-periods of the supply network voltage.

Figure 2:
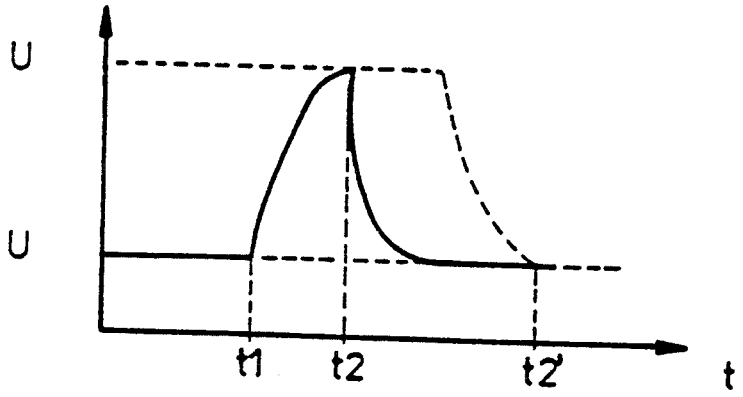
FIG. 2 is a diagram showing the automatic changing of the speed in time (reduced idle speed-working or maximum speed)

The phase regulator 23*b* can so be connected with the control circuit 23*a* that, in the disengaged position, the electric motor rotates with a predetermined idle speed $U_{min}$ (FIG. 2). When a signal "clutched" is communicated from sensor 24 or 24' at time t1, the controller 23*a* via the phase regulator 23*b* accelerates the motor 11 to a high predetermined working speed or maximum speed $U_{max}$, and the motor supplies at time t1–t2 the necessary torque for the screwing process.

It is also possible that the screwing process with the maximum speed lasts a predetermined time (as shown with dash lines), and only after this time expires, the speed is reduced to the predetermined idle speed at time t2. In every case, the speed is reduced to the noiseless idle speed $U_{min}$, and the coupling 20 is declutched when the screwing process is finished. Declutching is established by the distance sensor which generates a corresponding signal in response to which the phase regulator operates to reduce the motor speed to the predetermined idle speed. As it is customary for such screwdrivers, the declutching of the coupling 20, which is sensed by the distance sensor, is effected by a mechanical stop (depth stop) which at a predetermined time, i.e., when the torque reaches its maximum, opens the coupling as a result of axial movement of the device output shaft to the right. In response to declutching sensed by the distance sensor, an automatic switching to the reduced idle speed takes place. The speed controller 23 is connected to the network with an on-off switch 26 and effects speed control via another control element, i.e., potentiometer-knurl gear means 27 (FIG. 1) to provide the predetermined idle $U_{min}$ and working or maximum $U_{max}$ speeds.

Alternatively, it is possible in a non-operational condition of the device, to completely turn the motor off, and by selecting an appropriate claw coupling system ensure absence of a "tooth-against-tooth position" that may hinder coupling. It should be clear that the acceleration of the motor to the speed required for the screwing process depends on the screwdriver mechanics and the conducted screwing process and is accordingly selected.

Finally, it should be stated that the claims and, in particular, the main claim of the invention were drafted without the complete knowledge of the prior art and that is why they are without restricting prejudice. Therefore, all features described in the specification, recited in the claims and shown in the drawings taken alone or in different combinations, should be considered as having patentable significance and covered by the claims.

I claim:

1. A method of controlling operation of an electrical hand-held device, in particular, screwdrivers, hand drills, hammer drills, and the like, having an axially displaceable output shaft, an electric motor for driving the output shaft, an actuating coupling for connecting the output shaft with the electric motor and clutching upon application of pressure to the output shaft, and a speed controller for controlling a speed of the electric motor, said method comprising the steps of:

sensing a respective position of one of the output shaft and the coupling and generating, upon clutching of the output shaft actuating coupling, a speed acceleration signal; and in response to the speed accelerating signal, accelerating the electric motor from a predetermined idle speed to a predetermined working speed.

2. A method according to claim 1, further comprising the step of eliminating action of backward pressure on the output shaft to enable outward movement of the output shaft to thereby effect declutching of the coupling whereby the electric motor decelerates to said predetermined idle speed.

3. An electrical hand-held device comprising an axially displaceable output shaft, an electric motor for driving the output shaft, an actuating coupling for connecting the output shaft with the electric motor, a speed controller for the electric motor, distance sensor means for sensing one of a clutched and a declutched position of the actuating coupling and, for the clutched condition of the coupling, communicating a speed acceleration signal to the speed controller, the speed controller, in response to the speed acceleration signal, accelerating the electric motor from a predetermined idle speed to a predetermined working speed and maintaining the motor speed at the predetermined working speed.

4. The hand-held device according to claim 3, wherein the actuating coupling is a claw coupling having a first coupling part at least indirectly driven by the electric motor, and a second coupling part connected to the output shaft for joint axial displacement therewith and form-lockingly engaging the first coupling part in the operating position of the coupling in a backward pressed position of the output shaft.

5. The hand-held device according to claim 3, wherein means are provided to enable a gradual declutching of the actuating coupling upon progressive outward displacement of the output shaft whereby the distance sensor means, upon coupling declutching, causes the speed controller to switch the drive motor to said predetermined idle speed.

6. The hand-held device according to claim 3, wherein the distance sensor means is one of a mechanical switch, a microswitch, a contactless proximity switch an optical sensor, a Hall-sensor, a pneumatic sensor and the like.

7. The hand-held device according to claim 3, wherein the electrical hand-held device is formed as a gun-shaped device with a handle in which the drive motor is located, the drive motor including an inner rotatable jumper ring defining a direction of rotation and on/off positions of the electric motor and mechanically connected with an outer positioning ring mounted on the handle which forms a part of the device housing and serves as a change-over and on/off switch.

* * * * *